US008104415B2

(12) United States Patent
Higginson

(10) Patent No.: US 8,104,415 B2
(45) Date of Patent: Jan. 31, 2012

(54) SAILBOAT SUBSTANTIALLY FREE OF HEELING MOMENTS

(76) Inventor: John Matthew Higginson, Toronto (CA)

( * ) Notice: Subject to any disclaimer, the term of this patent is extended or adjusted under 35 U.S.C. 154(b) by 0 days.

(21) Appl. No.: 11/785,272

(22) Filed: Apr. 17, 2007

(65) Prior Publication Data

US 2008/0257244 A1 Oct. 23, 2008

(51) Int. Cl.
*B63H 9/04* (2006.01)

(52) U.S. Cl. ..... 114/39.29; 114/102.1

(58) Field of Classification Search .... 114/39.11–39.13, 114/39.29, 102.1, 102.16, 102.18, 102.19, 114/104–106, 39.26, 39.27
See application file for complete search history.

(56) References Cited

U.S. PATENT DOCUMENTS 1,670,936 A * 5/1928 McIntyre et al. ..... 114/39.29
4,047,493 A * 9/1977 Menegus ..... 114/102.16
4,196,687 A * 4/1980 Newick ..... 114/106

* cited by examiner

*Primary Examiner* — Edwin Swinehart

(57) ABSTRACT

A sailboat includes a sail assembly with opposing upper and lower ends, a leading edge and a trailing edge. The sail assembly is normally offset from the hull and oriented for generation of a propelling force substantially free of heeling moments. A support structure supports the sail assembly for rotation about an axis inclined relative to vertical and substantially parallel to the leading edge. The support structure includes an upper rotary joint mounting the upper end of the sail assembly to the support structure and a lower rotary joint mounting the lower end of the sail assembly to the support structure. The rotary joints are positioned to allow unobstructed rotation of the sail assembly fully through 360 degrees about the inclined axis. At least part of the support structure is mounted for rotation together with the sail assembly and the inclined axis relative to the hull, largely eliminating weather helm. Controls are provided to permit adjustment of the angular orientation of the sail assembly about the inclined axis thereby adjusting propelling force.

14 Claims, 10 Drawing Sheets

SAILBOAT SUBSTANTIALLY FREE OF HEELING MOMENTS

FIELD OF THE INVENTION

The invention relates generally to sailboats, and, more specifically, to sailboats that support a sail in such a manner as to substantially eliminate heeling moments.

BACKGROUND OF THE INVENTION

The speed of a conventional sailboat is limited by a phenomenon referred to as "heeling." Wind produces a force or thrust generally normal to the sail surface, and the lateral component of this force is resisted by an opposing force applied by water to the keel of the boat. Such forces create a moment that tilts, and can potentially overturn, a boat. A common way to compensate for heeling is to employ a heavy keel that counterbalances the heeling moments to some degree. This has the drawback, however, of increasing the weight of the boat and causing the hull to ride deeper in the water, increasing drag. Another form of compensation is to locate passengers on the windward side of the sail or to have passengers lean from the windward side of the boat over the water. However, the tendency to heel increases with wind force and ultimately limits the speed at which the boat can be safely operated despite compensating measures.

A class of sailing craft has been proposed in which rigging supports the sail assembly so as to generate a propelling force substantially free of heeling moments. In such a craft, a sail is supported in such a manner that the thrust created by wind action and the corresponding keel force are substantially aligned and directed through a single point. Proposals for sail craft embodying such an operating principle are to be found in U.S. Pat. No. 1,670,936 to McIntyre et al, U.S. Pat. No. 4,068,607 to Harmon, U.S. Pat. No. 4,809,629 to Martinmaas, U.S. Pat. No. 6,732,670 Rayner, and International Publication No. WO 01/00486 of inventor Stenros. Such a sail arrangement will also tend to lift the craft, reducing displacement and hull drag. Despite obvious advantages, such sailing craft remain relatively unused, and it is an object of the present invention to provide a practical implementation of a sailboat belonging to this class of sailing craft.

SUMMARY OF THE INVENTION

In one aspect, the invention provides a sailboat comprising a sail assembly with a pair of opposing upper and lower ends and leading and trailing edges that extend between the opposing ends. Means are provided to support the sail offset from the hull and oriented so as to generate a propelling force substantially free of heeling moments. A support structure orients the sail assembly for rotation about an axis inclined relative to vertical and substantially parallel to the leading edge of the sail assembly. For purposes of this specification, such rotation should be understood as a rotation of the entirety of the sail assembly about the axis, which tends to displace each point on the sail assembly substantially through the same angle about the axis. The support structure comprises an upper rotary joint mounting the upper end of the sail assembly to the support structure and another rotary joint mounting the lower end of the sail assembly to the support structure. The rotary joints are positioned to allow rotation of the sail assembly about the inclined axis fully through 360 degrees unobstructed by the support structure. Mounting means are provided to mount the support structure to the hull for rotation together with the inclined axis about a vertical axis, effectively decoupling the hull from the sail assembly so as to reduce weather helm.

Control means are provided to control the angular orientation of the sail assembly about the inclined axis, which allows control of the thrust generated by the sail assembly. The control means preferably comprise an inhaul line fastened to the sail assembly together with means decoupling the inhaul line from effects of rotation of the supporting structure about the vertical axis. The decoupling means preferably comprise moveable means that draw a partial loop from the rest of the line. The moveable means are controlled in response to rotation of the support structure, paying out the partial loop to the rest of the line in response to rotation of the support structure in either angular direction from a predetermined angular position (a home position), and hauling in the partial loop from the rest of the line in response to rotation of the support structure toward the predetermined position. The control means may also comprise a biasing mechanism that urges the sail assembly to locate in a rest position from which a single inhaul line can be hauled in or paid out to control the angle of attack of the sail assembly relative to the wind.

Several advantages should be noted. Supporting the sail assembly by its ends provides a stronger, simpler structure better able to resist twisting forces such as those due to wind shear, accidental water contact, and transient forces during sailing maneuvers. The freedom of the sail assembly to rotate 360 degrees about its inclined axis provides important benefits over the prior art. Tacks and gibes are possible in which the sail direction is reversed by pulling the trailing edge of the sail inward between the inclined and vertical axes, which are easier and more analogous to traditional sailboat tacks and gibes, and are not possible using prior art no-heel craft. The arrangement also lends itself to controlling the sail rig by hauling in and paying out a single inhaul rope (as described more fully below), which greatly simplifies tacks and gibes. In addition, there is an important safety benefit in that sail force can be fully released by simply slackening the inhaul rope, regardless of wind direction, even if the rotation of the support structure about the vertical axis has been blocked due to water contact, fouled lines, or other accident. The sail can never be pinned against its support structure by the wind, and can always be released from any position to 'weather-vane' away from the wind.

Various aspects of the invention will be apparent from a description below of preferred embodiments and will be more specifically defined in the appended claims. It should be noted that the term "sail assembly" as used in this specification identifies a structure comprising an airfoil capable of converting airflow over the airfoil into lift perpendicular to the direction of airflow, including a sail formed with flexible sheet material or a rigid wing. This specification also refers to support structures that comprise a generally vertical member and a generally horizontal member. The terms "generally vertical" and "generally horizontal" should not be interpreted as requiring precise vertical or horizontal orientations. A generally vertical member, for example, may be angled in appropriate cases by as much as 45 degrees relative to true vertical, particularly where a multi-hull boat is involved or where the angle of the inclined axis differs from 45 degrees, the angle of inclination associated with the preferred embodiments described below.

DESCRIPTION OF THE DRAWINGS

The invention will be better understood with reference to drawings in which.

DESCRIPTION OF PREFERRED EMBODIMENT

Figures 1, 2A, 2B:
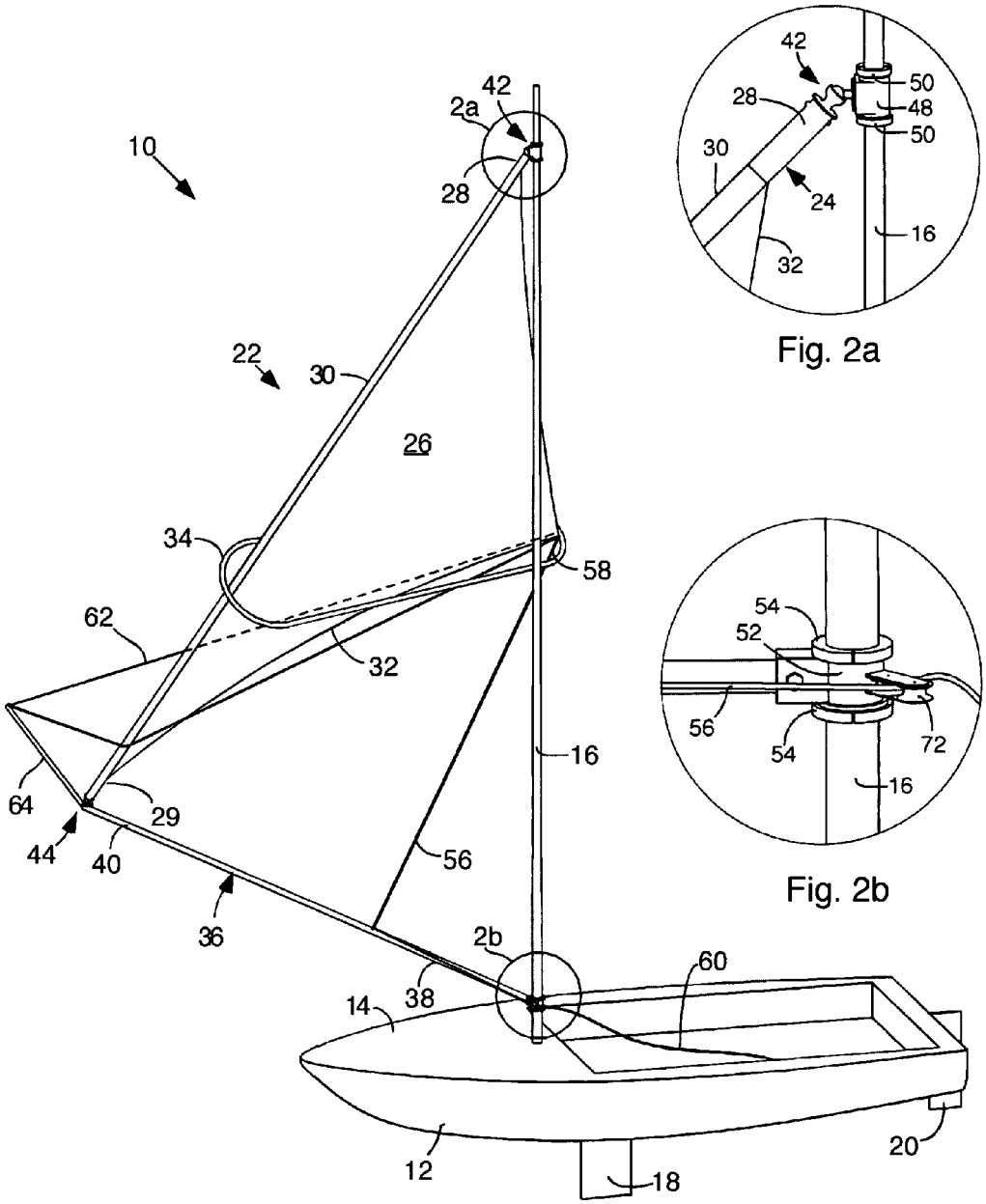
FIG. 1 is a perspective view of a sailboat.
FIGS. 2*a* and 2*b* are expanded views of structure respectively in circles 2*a* and 2*b* of FIG. 1.

Reference is made to FIG. 1, which illustrates a sailboat 10 embodying the invention. The sailboat 10 comprises a hull 12, a deck 14, a mast 16 rigidly fixed to the deck 14, a keel 18 and a rudder 20, all of conventional construction. The sailboat 10 also has a sail assembly 22 that is normally offset from the hull 12 and oriented to produce a propelling force substantially free of heeling moments.

The sail assembly 22 is constructed of a rigid shaft 24 (indicated in FIG. 2*a*) and sheet material 26 such as canvas or a plastic normally used in the fabrication of sails. The shaft 24 defines upper and lower ends 28, 29 of the sail assembly 22 by means of which the sail assembly 22 is supported. The sheet material 26 is formed with a sleeve (not detailed) that receives the shaft 24 to define the leading edge 30 of the sail assembly 22, and the sheet material 26 itself defines the trailing edge 32 of the sail assembly 22. The leading and trailing edges 30, 32 may be seen to extend between the upper and lower ends 28, 29 of the sail assembly 22. A boom 34 is mounted to the shaft 24 in an orientation transverse to both the leading and trailing edges 30, 32, and the rear end of the boom 34 is fastened to the sheet material 26 proximate to the trailing edge 32.

The sail assembly 22 is supported for rotation about an axis inclined at about 45 degrees relative to vertical. The inclined axis is proximate to and substantially parallel to the leading edge 30 of the sail assembly 22. The structure supporting the sail assembly 22 includes the vertical mast 16 and a generally horizontal member 36 with one end 38 proximate to the mast 16 and an opposing end 40 distant from the mast 16. The support structure also includes an upper rotary joint 42 (a ball and socket as apparent in FIG. 2*a*) that secures the upper end 28 of the sail assembly 22 to the upper end 28 of the mast 16, and a lower rotary joint 44 (a ball and socket) that secures the lower end 29 of the sail assembly 22 to the distal end 40 of the generally horizontal member 36. The rotary joints 42, 44 are so positioned that the sail assembly 22 rotates fully through 360 degrees about the inclined axis unobstructed by the support structure. It is not imperative that the rotary joints 42, 44 be ball-and-socket joints, and any joints capable of constraining rotation of the sail assembly 22 about the inclined axis would be acceptable rotary joints for purposes of the invention. Releasable joints may be preferred for ease of assembly and disassembly.

The sail assembly 22 is free to rotate relative to the hull 12 about the vertical axis of the mast 16. To that end, the upper rotary joint 42 is itself fastened to the mast 16 with a sleeve 48 fitted around the upper end of the mast 16 for relative rotation and held in place by upper and lower mounting rings 50 fixed to the mast 16. The proximate end 38 of the horizontal member 36 is similarly attached by means of a sleeve 52 and a pair of mounting rings 54 to the lower end of the mast 16. Rotation of the sail assembly 22 and support structure about the vertical axis is left uncontrolled during normal operation allowing the sail assembly 22 to self-align relative to the wind. Since the sail assembly 22 rotates freely about the vertical axis relative to the hull 12, no significant moments are transmitted between the sail assembly 22 and the hull 12, and the boat is consequently not subject to weather helm.

A rope inhaul line 56 is used to control the angular orientation of the sail assembly 22 about the inclined axis and consequently the angle of attack of the sail assembly 22 with respect to the apparent wind, which allows the skipper to control the force produced by the sail assembly 22. The inhaul line 56 has one end 58 fastened to the rear of the boom 34 and an opposing end 60 that can be held by the skipper of the craft or fastened to a cleat.

During steady sailing, the sail assembly 22 remains within an operating range in which the sail assembly 22 is substantially perpendicular to the general plane containing the mast 16 and the generally horizontal member 36, as shown in FIG. 1. Gravity will tend to pull the sail assembly downward, out of the operating range, and in light winds, there may not be sufficient sail force to overcome gravity and hold the sail assembly in the operating range. An elastomeric cord 62 is fastened to a forward structure 64 at the distal end 40 of the generally horizontal member 36, passes through a pulley (not shown) fixed to the rear of the boom 34, and extends back around the opposite side of the sail assembly 22 to the forward structure 64, effectively providing one length of cord on either side of the sail assembly 22. The cord 62 is tensioned so as to urge rotation of the sail assembly 22 against the pull of gravity to an angular position beyond the operating range. The inhaul line 56 can consequently be hauled in against the biasing force to rotate the sail assembly 22 into the operating range. The inhaul line 56 may then be paid out or hauled in to finely adjust the angle of attack of the sail assembly 22. Although an elastomeric cord 62 has been suggested in this embodiment of the invention, the required biasing may alternatively involve counter-weighting the sail assembly 22, providing a spring-actuated cam and follower device, or any of myriad known torque actuators.

Figure 3:
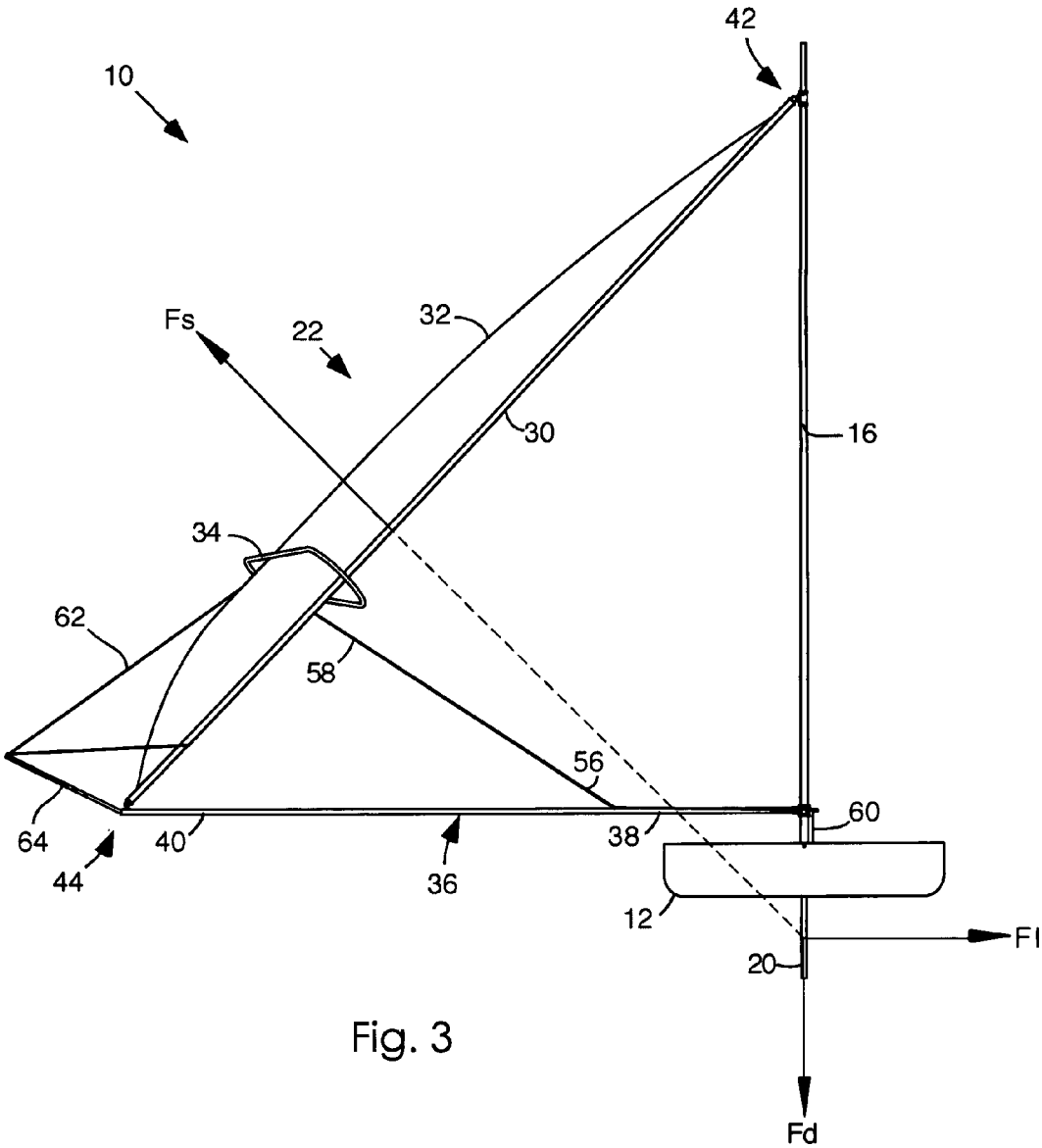
FIG. 3 is a diagrammatic end view showing certain forces arising with operation of the sailboat.
Figure 4:
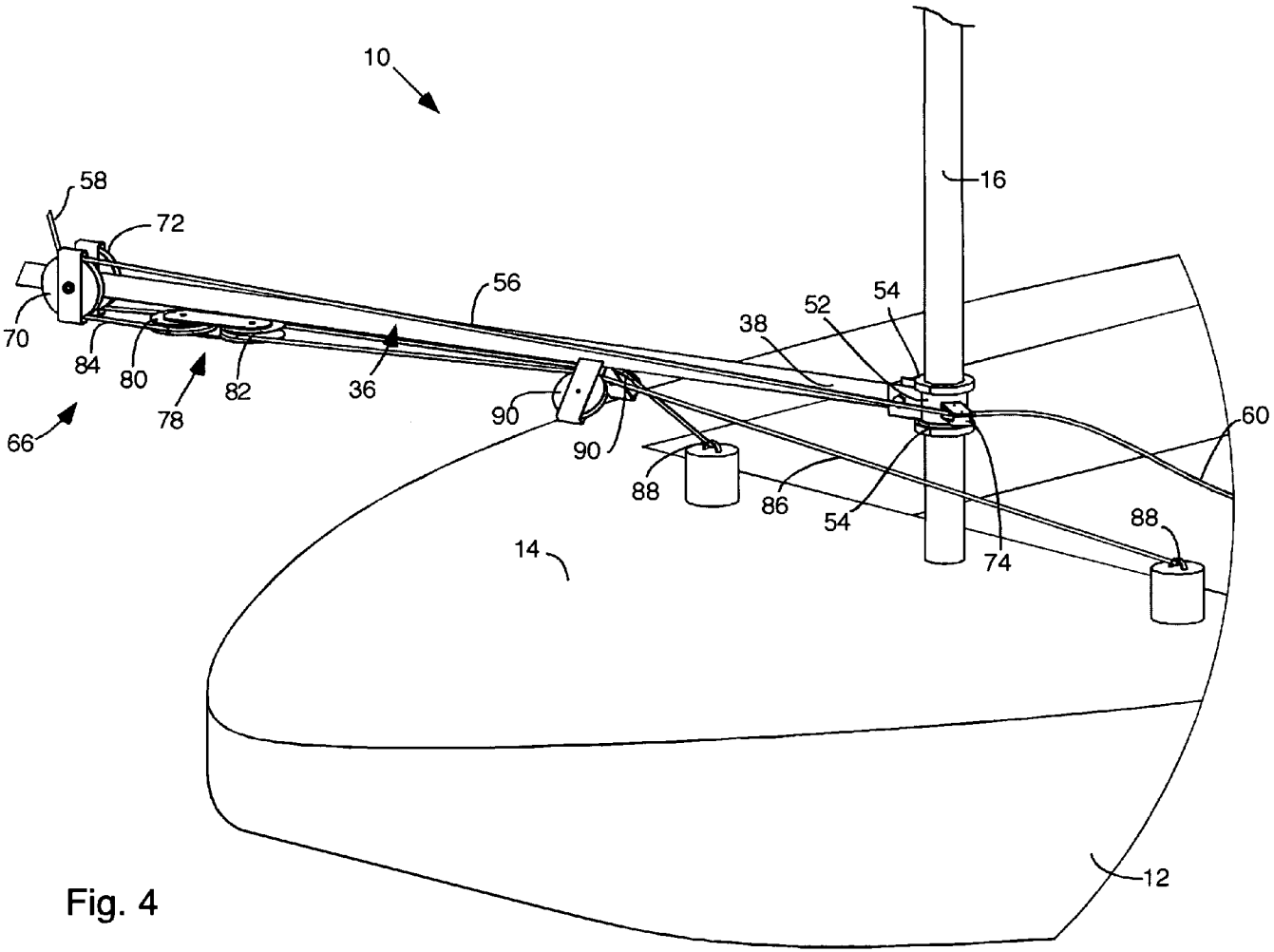
FIG. 4 is a fragmented perspective view showing a line control mechanism that operates on an inhaul line.

Reference is made to FIG. 3, which is a diagrammatic end view of the sailboat 10 showing lateral components of principal forces arising during normal operation of the sailboat 10. The sail assembly 22 responds to wind forces by producing a force Fs normal to the surface of the sail assembly 22 and aligned with an axis extending through the center of effort of the keel 18. The force Fs is substantially balanced by a lateral reactive force Fl applied to the keel 18 and a downward reactive force Fd. An unbalanced component of the force Fs, perpendicular to the page in this view, tends to propel the sailboat 10 in a forward direction. What should be apparent from FIG. 3 is that these forces are aligned and act substantially through a common point, which substantially eliminates heeling moments regardless of wind force and the speed at which the sailboat travels.

When, in response to an inhaul adjustment, the sail assembly 22 and the support structure rotate to find a new stable position, something resembling a feedback arrangement is created that makes the rig very sensitive to small adjustments in the inhaul line 56 and to wind changes. This high sensitivity may be acceptable and even desirable in small, high performance boats in which the crew is making constant adjustments. However, to increase stability for other embodiments, it is desirable to decouple the control line and consequently the angle of attack of the sail assembly 22 from the effects of rotation of the sail assembly 22 about the vertical axis relative to the hull 12. To that end, a control mechanism 66 is provided that operates between the ends of the inhaul line 56. Components of the mechanism 66 have not been illustrated in FIG. 1 owing to issues of scale, but the control mechanism 66 and its operation will be apparent in the fragmented views of FIGS. 4 and 5*a*-5*c* where the sizes of components of the mechanism 66 have been exaggerated for purposes of illustration.

The control mechanism 66 includes pulleys that guide movement of the inhaul line 56 along a predetermined path along the generally horizontal member 36. Forward pulleys 70, 72 are mounted to the generally horizontal member 36, and rearward pulleys 74, 76 are mounted as a single unit to the lower sleeve 52. The control mechanism 66 also includes a moveable element 78 comprising a pair of forward and rear pulleys 80, 82 mounted to a common frame. The forward pulley 80 draws a partial loop 84 of line from the path of the rest of the inhaul line 56, and the rear pulley 82 is operatively engaged with a separate rope line 86 used to pull or release the moveable element 78 in response to rotation of the sail assembly 22 relative to the hull 12. The rope line 86 has opposing ends 88 fixed to the deck 14 and is conveyed about two pulleys 90 mounted for rotation with the generally horizontal member 36 about the vertical axis.

Figures 5A, 5B, 5C:
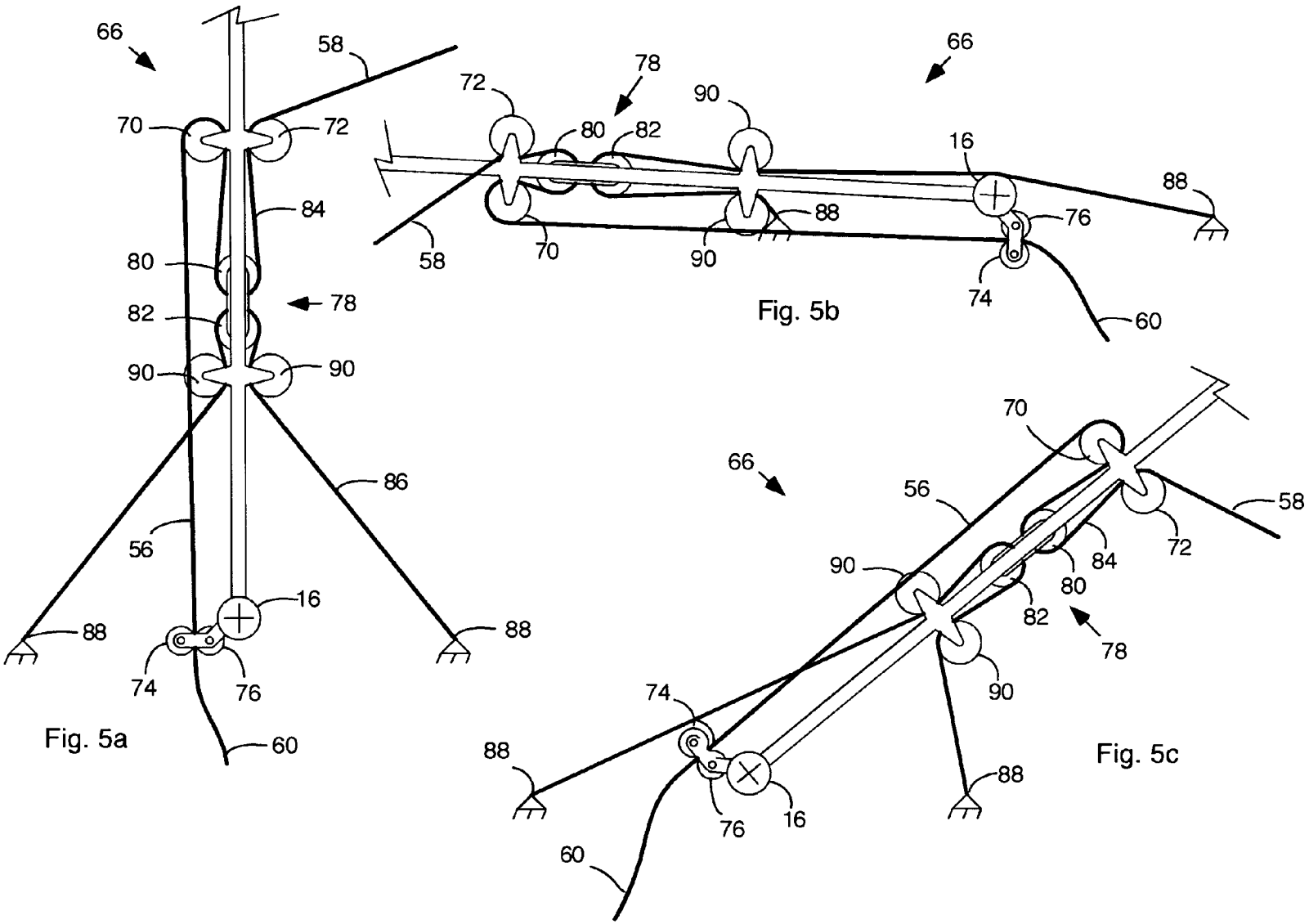
FIGS. 5*a*-5*c* are diagrammatic plan views showing how the line control mechanism pays out and hauls in a partial loop of the inhaul line in response to rotation about a central mast.
Figure 6:
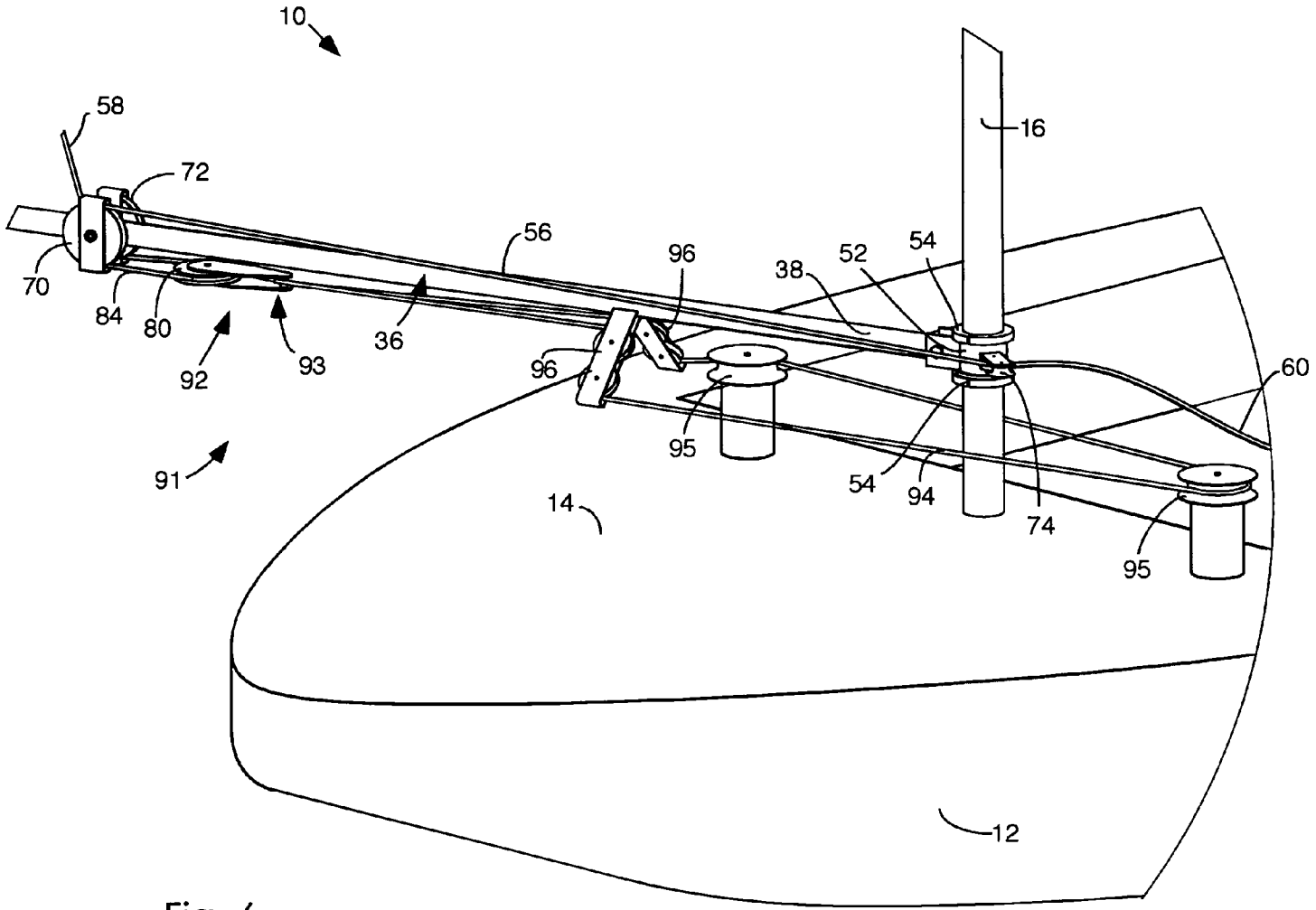
FIG. 6 is a fragmented perspective view showing an alternative line control mechanism operating on the inhaul line.
Figure 7A:
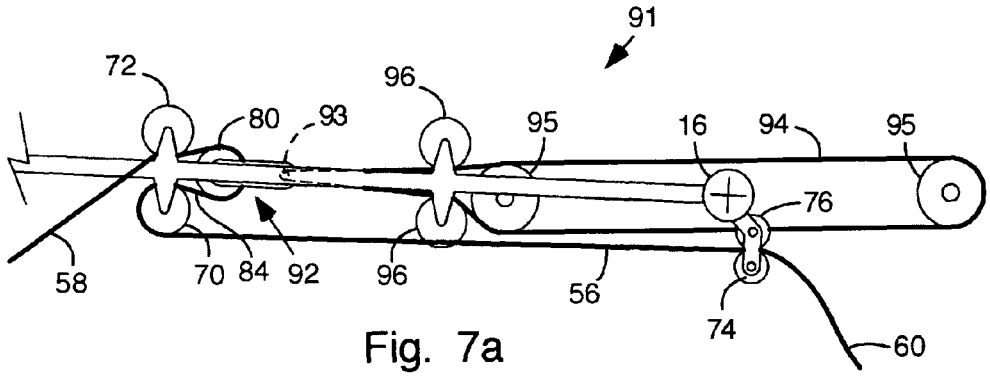
FIGS. 7*a*-7*c* are diagrammatic plan views showing how the line control mechanism of FIG. 6 pays out and hauls in a partial loop of the inhaul line in response to rotation about the central mast.
Figure 7B:
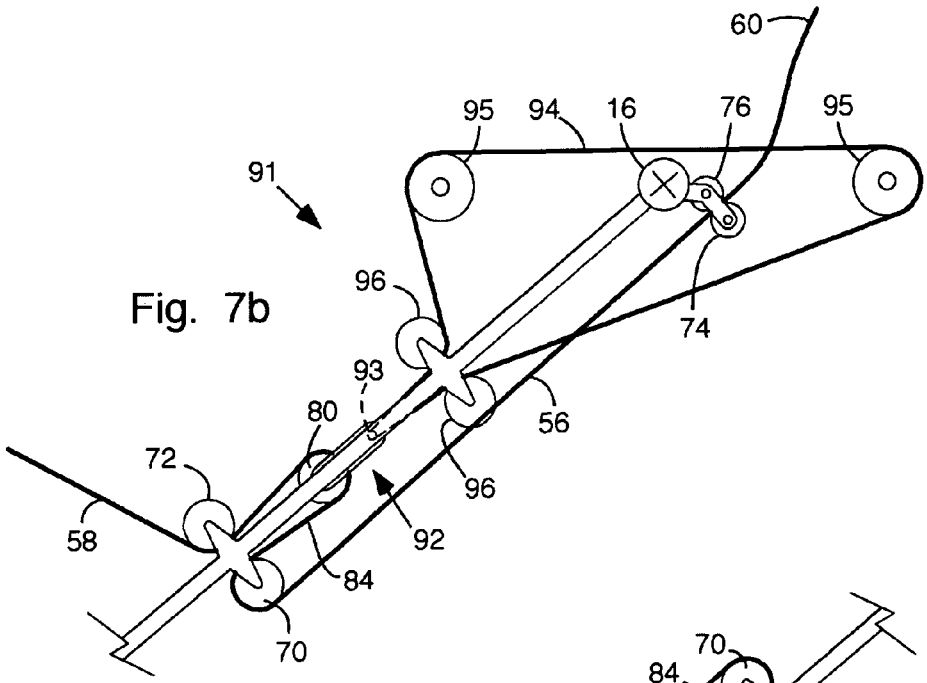
Figure 7C:
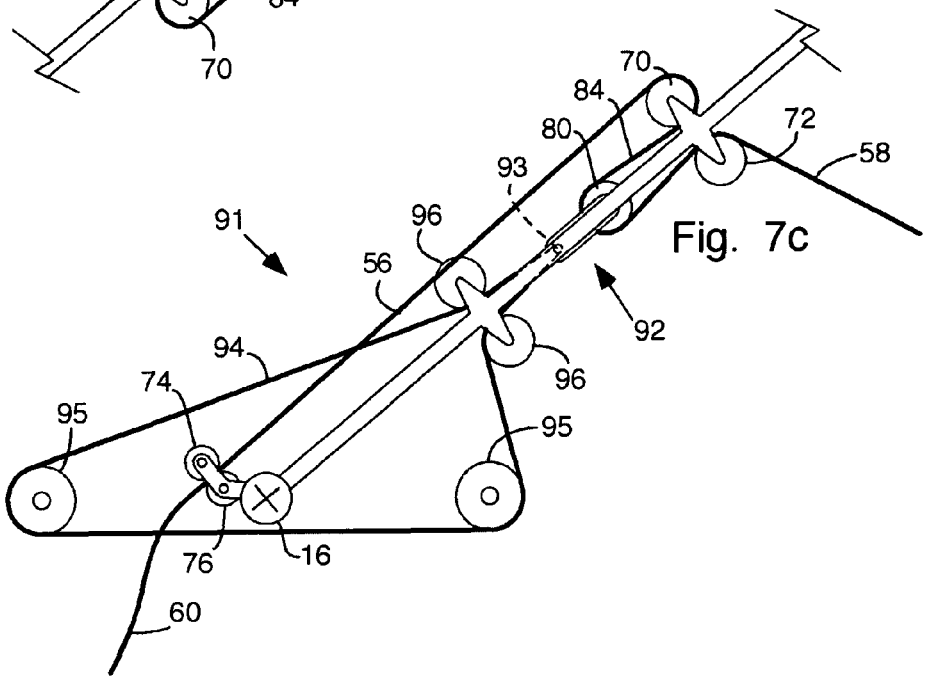

The angular position of the generally horizontal member 36 about the vertical axis shown in FIG. 5*a* may be regarded as a home position, which is inline with the central lengthwise axis of the boat. In the home position, the control mechanism 66 has hauled in the partial loop 84 to the maximum extent permissible in this embodiment. When rotated in either angular direction relative to the home position, the control mechanism 66 pays out the partial loop 84 to the rest of the inhaul line 56. For example, as the generally horizontal member 36 rotates from the home position toward the angular position shown in FIG. 5*b*, roughly 90 degrees from the home position in a clockwise direction as viewed from above, the moveable element 78 pays out the partial loop 84 to the inhaul line 56 substantially to the maximum extent permissible in this implementation. If the generally horizontal member 36 rotates in the opposite angular direction from the home position, as to the position shown in FIG. 5*c*, the partial loop 84 is also progressively paid out. As the generally horizontal member 36 rotates toward the home position from either position shown in FIGS. 5*b* and 5*c*, the partial loop 84 of line is progressively hauled in. Steps may be taken in such an implementation to limit rotation of the generally horizontal member 36 to a forward range of roughly 180 degrees.

In use, the sail assembly 22 will tend to rotate automatically in response to changes in the direction of incident wind until wind forces on the sail assembly 22 act substantially through the vertical axis. The control mechanism 66 effectively pays out and hauls in the line to reduce or eliminate changes in the angle of the sail assembly 22 with respect to the wind as a result of rotation.

It should be noted that in this embodiment all tacking and gibing are accomplished by the sail assembly 22 rotating inward, that is, with the trailing edge 32 passing between the mast 16 and the generally horizontal member 36. The inhaul rope control system in this embodiment will become ineffective if the sail assembly 22 is rotated in an opposing angular direction. If the inhaul line 56 is released, the sail assembly 22 will "weather-vane" away from the wind, and is free to rotate as far as required in any direction to release sail force. This is an important safety feature, because it allows all sail force to be released rapidly simply by releasing the inhaul rope, regardless of the angular position of the generally horizontal member 36 relative to the vertical axis. Even if rotation of the generally horizontal member 36 about the vertical axis is blocked in any position, sail force can still be released by slackening the inhaul rope and allowing the sail assembly to weather-vane.

An alternative control mechanism 91 adapted to handle rotation of the generally horizontal member 36 fully through 360 degrees about the vertical axis is shown in FIGS. 6 and 7*a*-7*c*, where components common to the two control mechanisms 66, 91 are identified with like reference numerals. In the alternative control mechanism 91, moveable element 78 is replaced with a moveable element 92, in which pulley 82 is replaced with a post 93, and pulleys 90 are replaced with double pulleys 96. A rope line 94 has both ends tied to post 93 and is conveyed over two large pulleys 95 mounted to the deck 14. The rig is free to rotate 360 degrees around the vertical axis without fouling any control lines. When the rig is in the rearward 180 degrees of its travel with the pulleys 90 astern of the deck-mounted pulleys 95, the effect of the control mechanism 91 is reversed, which reduces stability but aids in executing tacks and gibes. The stable range of the control mechanism 91 can be varied by placing the pulleys 95 at any point in a circle around mast 16 and adding a third pulley around the mast 16 itself. A fully stable mechanism can be built by replacing pulleys 95 with a pulley around the mast 16 and a pulley behind it on the centerline of the hull, however this would not have the benefits of easier tacking and gibing. The effectiveness of either of the control mechanisms 66, 91 can be altered by increasing or decreasing the diameter of the circle described by pulleys 90 or 96, or by other geometrical variations, which will be apparent to those skilled in the art.

Figure 8:
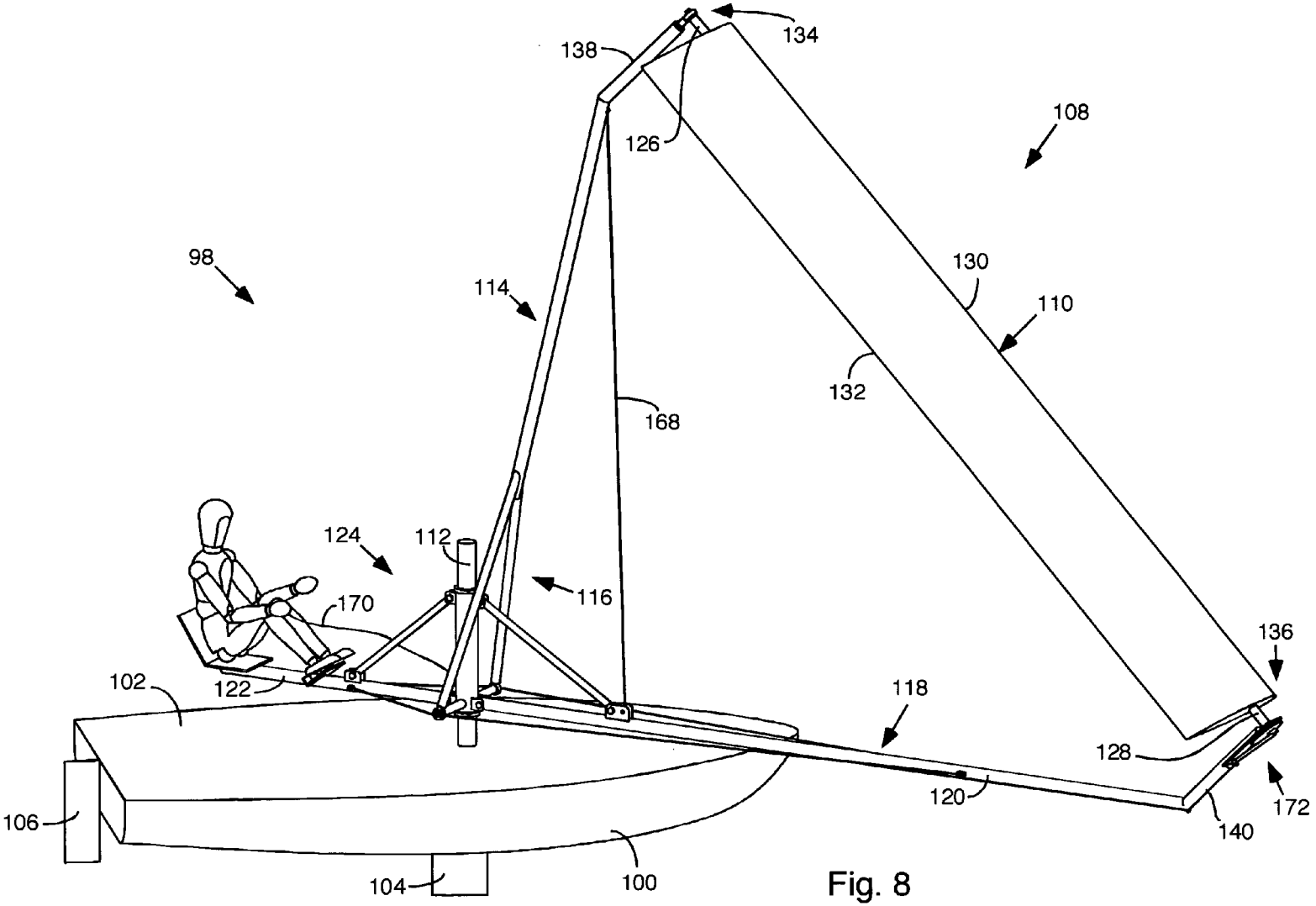
FIG. 8 is a perspective view of a sailboat that incorporates a rigid wing.

Reference is made to FIG. 8, which illustrates another sailboat 98 embodying the invention. The sailboat 98 comprises a hull 100, a deck 102, a keel 104 and a rudder 106, all of conventional construction. One significant difference relative to the sailboat 10 of FIG. 1 is a sail assembly 108 that incorporates a rigid wing 110. Another significant difference is that the structure supporting the sail assembly 108 is now mounted entirely to a stub mast 112 for rotation about a vertical axis. The support structure includes a generally vertical member 114 constructed with a forked base 116 to impart rigidity, and a generally horizontal member 118 constructed in forward and rear sections 120, 122. These components form a junction 124 surrounding the stub mast 112, that is more complex than the simple junction in the embodiment of FIG. 1.

An upper shaft 126 fixed to the wing 110 defines the upper end of the sail assembly 108 and a lower shaft 128 fixed to an opposing end of the wing 110 defines the lower end of the sail assembly 108. The wing 110 defines both leading and trailing edges 130, 132 of the sail assembly 108, which may be seen to extend between the upper and lower ends. An upper rotary joint 134 couples the upper shaft 126 of the sail assembly 108 to the generally vertical member 114, and a lower rotary joint 136 couples the lower shaft 128 of the sail assembly 108 to the generally horizontal member 120. The rotary joints 134, 136 constrain the sail assembly 108 to rotate about an inclined axis generally parallel to and proximate to the leading edge 130 (between the leading edge 130 and the center of thrust of the wing 110). The distal ends 138, 140 of the generally vertical and generally horizontal members 114, 118 are angled so as to closely support the sail assembly 108 while allowing necessary clearance for rotation. When mounted between the angled distal ends 138, 140, the sail assembly 108 can rotate fully through 360 degrees about the inclined axis without interference from the supporting structure.

Figure 10:
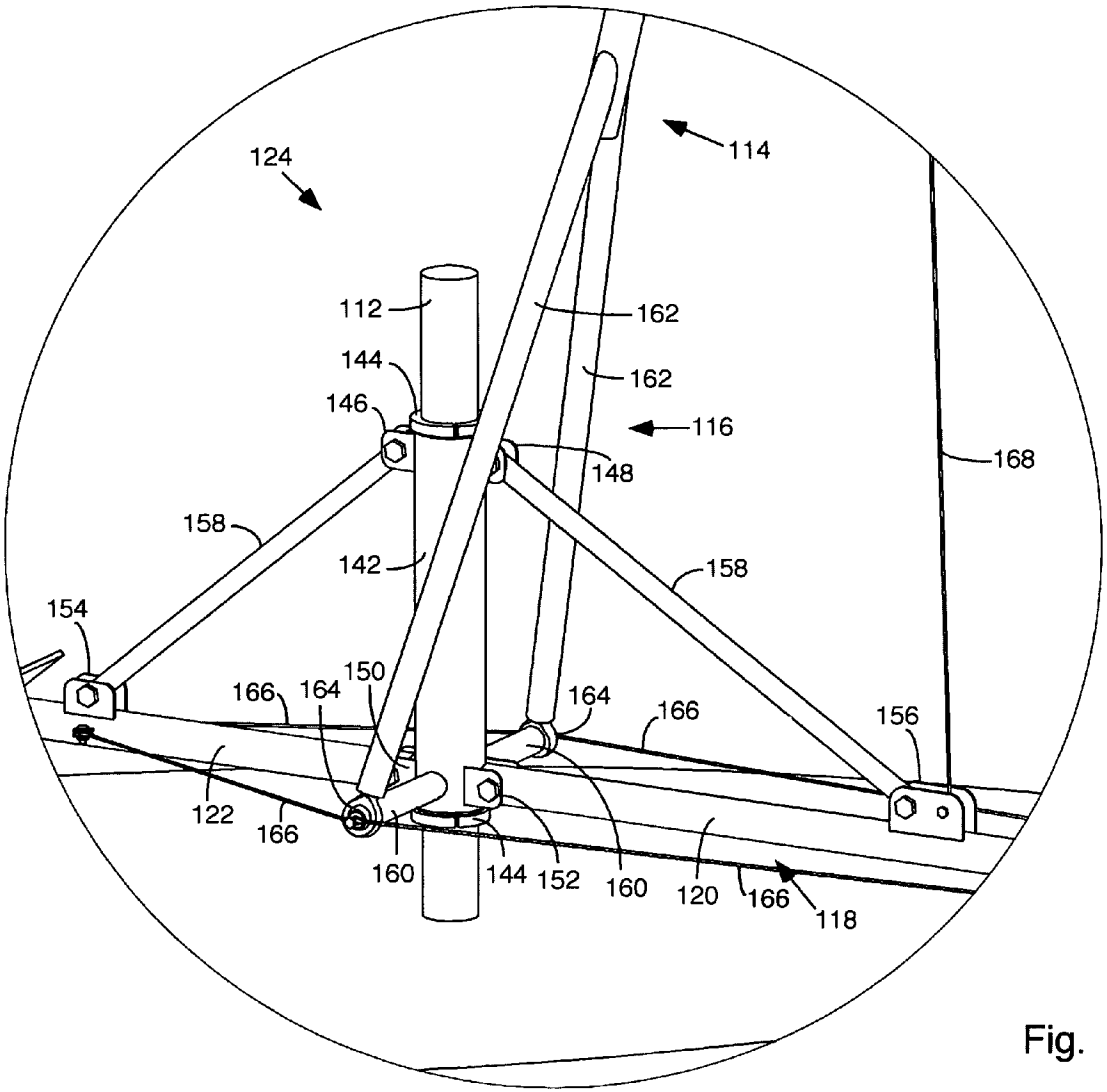
FIG. 10 is a fragmented perspective view of a junction formed by structures supporting the sail assembly of the sailboat of FIG. 8; and, FIGS. 11 and 12 are a plan view and a diagrammatic end view of a sailboat with a main hull and a secondary hull that supports the weight of a sail assembly outboard of the main hull.

The junction 124 surrounding the stub mast 112 is most apparent in FIG. 10. A cylindrical sleeve 142 is mounted about the stub mast 112 for relative rotation and held in place by upper and lower retaining rings 144 fastened to the stub mast 112. The sleeve 142 carries four pairs of mounting tabs 146, 148, 150, 152, all disposed substantially in a common vertical plane. The rear section 122 of the horizontal member 118 is bolted to the lower, rearward extending pair of mounting tabs 150, and the forward section 120 of the horizontal member 118 is bolted to the corresponding lower, forward directed mounting tabs 152. Each of the forward and rear member sections 120, 122 has rigidly fixed thereto a pair of mounting tabs 154 or 156 that opens upward. Tubular struts 158 are mounted with bolts or pins between the upper pairs of mounting tabs 146, 148 and the paired mounting tabs 154, 156 associated with the horizontal member 118 to reinforce the junction 124 and impart rigidity to the horizontal member 118.

Two circular shafts 160 are rigidly fixed to, and extend in opposite directions from, the sleeve 142. The shafts 160 are disposed in a vertical plane substantially perpendicular to the vertical plane occupied by the various pairs of mounting tabs 146, 148, 150, 152. Each fork 162 of the generally vertical member 114 is mounted with a bearing 164 to a different one of the shafts 160, which permits rotation of the generally vertical member 114 in the vertical plane containing the mounting tabs 146, 148, 150, 156, facilitating installation and removal of the wing 110. Four guy wires 166 fastened to the shafts 160 and to the forward and rear sections 120, 122 of the horizontal member 118 serve in a conventional manner to reinforce the horizontal member 118. A guy wire 168 extends vertically between the distal end 138 of vertical member 114 and the pair of mounting tabs 156 attached to the forward section 120 of the horizontal member 118. During high-wind conditions, this wire 168 transmits lift forces from the wing 110 to the junction 124 more directly and more rigidly than would be the case if the lift were transmitted through bending of the horizontal member 118.

The controls associated with the sailboat 98 once again include an inhaul line 170 that is used to set the angle of incidence of the sail assembly 108 relative to wind and consequently thrust generation. Although not illustrated, a control mechanism, such as one of the mechanisms 66, 91 described above, may be used to isolate the inhaul line 170 from effects of rotation of the supporting structure about the vertical axis of the stub mast 112.

Figure 9A:
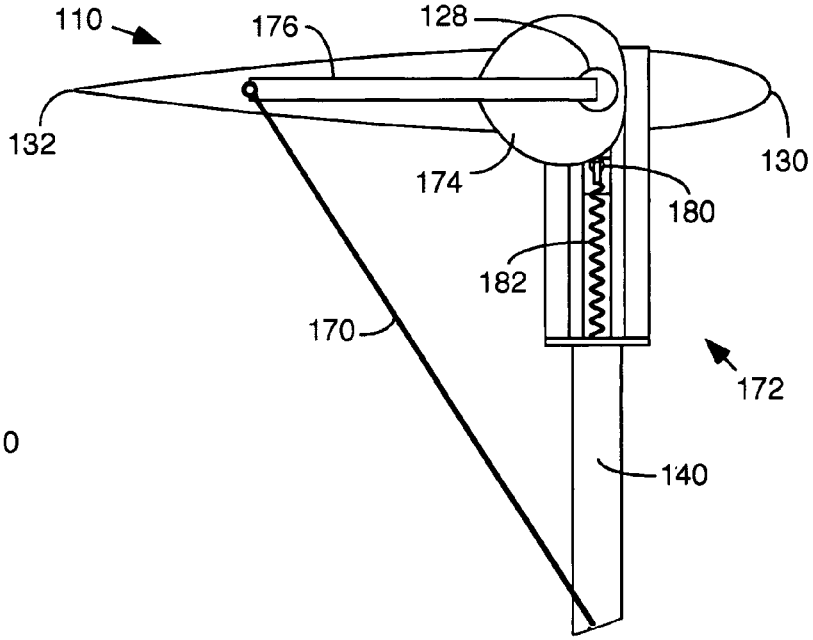
FIGS. 9*a* and 9*b* are fragmented views showing the wing respectively in operating and rest positions.
Figure 9B:
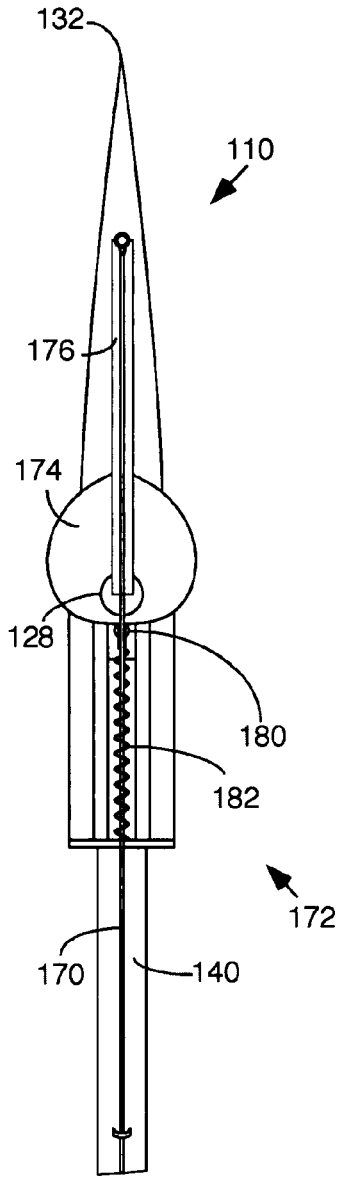

The controls associated with the sailboat 98 include a biasing mechanism 172 apparent in FIGS. 9*a* and 9*b*. The biasing mechanism 172, which serves essentially the same purpose as the elastomeric cord 62 in FIG. 1, urges the wing 110 toward a rest position shown in FIG. 9*b*. In the rest position, the sail wing 110 is located substantially in the general plane containing the vertical and horizontal members 114, 118 while in the operative position the wing 110 is oriented substantially perpendicular to that plane. The biasing mechanism 172 includes a generally heart-shaped cam 174 that is mounted to the lower shaft 128 of the sail assembly 108 perpendicular to the inclined rotational axis, and a lever 176 fastened to and extending radially away from the lower shaft 128 to which the inhaul line 170 is fastened. The biasing mechanism 172 includes a follower in the form of a roller 180 urged by a coil spring 182 against the periphery of the cam 174. If the inhaul line 170 is released, the roller 180 and coil spring 182 force the cam 174 to rotate the sail assembly 108 against the pull of gravity until a stable orientation corresponding to the rest position of the sail assembly 108 is achieved. During normal operation, the forces applied to the sailboat 98 are comparable to those illustrated in FIG. 3 in respect of the sailboat 10. Tacking and gibing in this embodiment can be achieved by swinging the sail assembly around inside or outside of the support structure, since the biasing means 172 and inhaul line 170 will not be fouled by full rotation.

Figure 11:
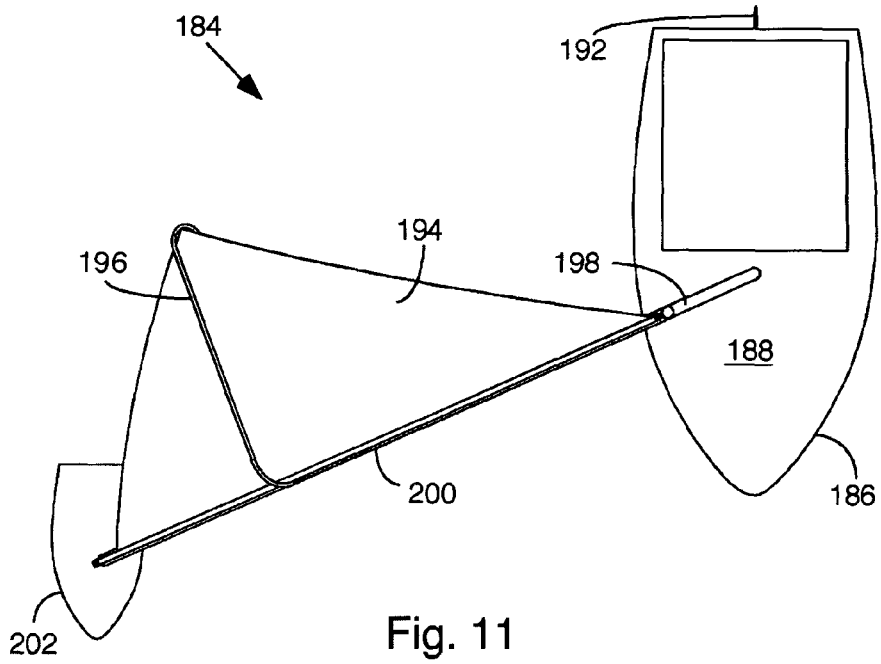
Figure 12:
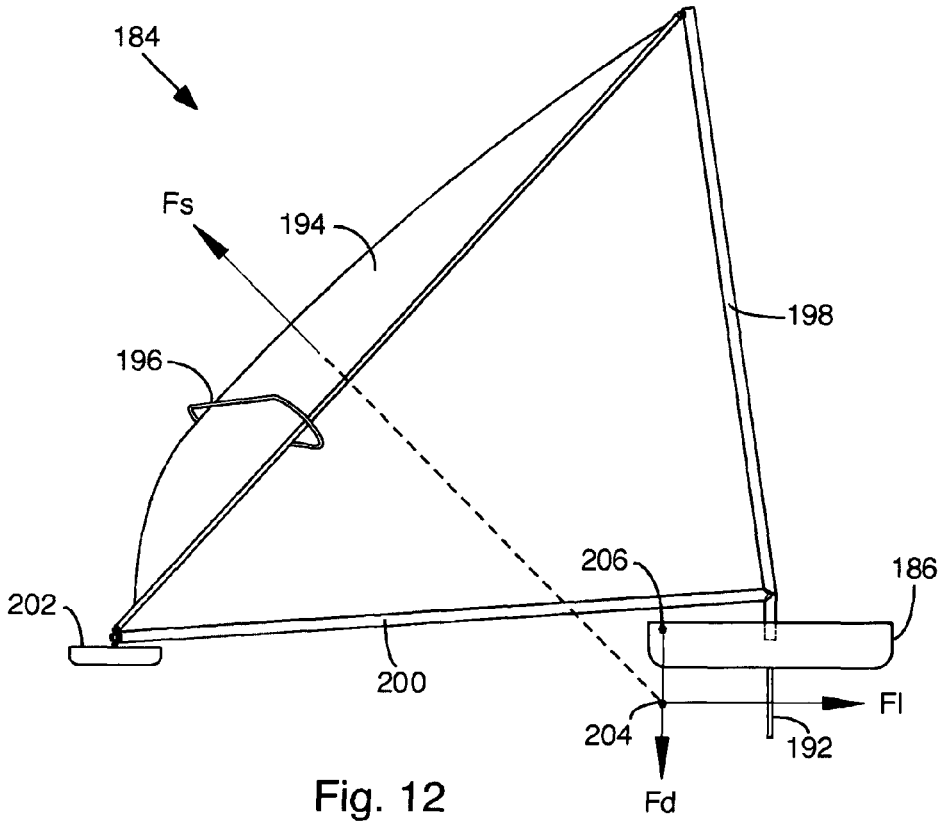

Reference is made to FIGS. 11 and 12, which illustrate another sailboat 184 embodying the invention. The sailboat 184 has a hull 186, a deck 188, a keel 190 and a rudder 192, all of conventional construction. The sailboat 184 also comprises a sail assembly 194 with a boom 196, which is comparable to the sail assembly 194 of the sailboat 10 of FIG. 1 and consequently will not be described further. The sailboat 184 has support structure supporting the sail assembly 194 for rotation about an axis inclined substantially at 45 degrees relative to vertical. The support structure includes a generally vertical member 198 and a generally horizontal member 200, which, for practical purposes, is integral to and rotates with the vertical member 198. The support structure also includes rotary joints (not illustrated but comparable to those of the sailboat 10 of FIG. 1) that mount the sail assembly 194 for unobstructed rotation about the inclined axis.

In the sailboat 184 of FIGS. 11 and 12, there are two significant differences relative to the embodiment of FIG. 1. First, the vertical support member 198 is itself mounted to the hull 186 for rotation about a vertical axis. Second, a second hull 202 is used to support the weight of the sail assembly 194 and its supporting structure, particularly the horizontal member 200. In normal operation, the sail assembly 194 assumes an orientation in which the force generated by wind on the sail assembly 194 passes substantially through a point 204 directly below the center of mass 206 of the entire assembly and laterally aligned with the center of effort of the keel 190. Accordingly, the sailboat 184 is not subject to significant heeling moments.

The preferred embodiments use a traditional rope inhaul line in order to give the skipper a simple control with the feel of a traditional sailboat mainsheet inhaul. Replacing the rope inhaul line with a push-pull or bi-directional rotational actuator would eliminate the need for the biasing means, and in many embodiments the decoupling device as well, since control can be inherently decoupled from rotation about the vertical axis.

During normal operation, including basic tacking and gibing, the rotation of the generally horizontal member 200 about the vertical axis will remain in the forward 180 degrees. If the shape and position of the support structure are such that rotation outside this range would interfere with the crew in the rear of the boat, then a positive stop should be used to limit travel to the forward 180 degrees. It could also be used to secure the horizontal member (and hence the angular position of the entire rig about the vertical axis) in the forward most position for safety and convenience during docking, rigging or de-rigging, etc.

If a specific embodiment permits 360 degree rotation about the vertical axis without risk to the crew, then certain alternative tacking and gibing maneuvers become possible, and the boat may even be powered in reverse.

It will be appreciated that particular embodiments of the invention have been described and illustrated, and that modifications beyond those already suggested in this specification may be made without necessarily departing from the scope of the appended claims.

I claim:

1. A sailboat comprising:

a hull, a keel, and a rudder;

a sail assembly comprising a pair of opposing upper and lower ends, a leading edge extending between the opposing ends, and a trailing edge extending between the opposing ends;

support means supporting the sail assembly, the support means comprising a support structure supporting the sail assembly for rotation about an axis inclined relative to vertical and offset from the hull such that the plane defined by the line of action of the aerodynamic force of the sail assembly as it is rotated about the inclined axis passes substantially through the center of effort of the keel, the support structure comprising an upper rotary joint mounting the upper end of the sail assembly to the support structure and a lower rotary joint mounting the lower end of the sail assembly to the support structure, the rotary joints positioned to allow unobstructed rotation of the sail assembly fully through 360 degrees about the inclined axis;

mounting means mounting at least part of the support structure together with the sail assembly and the inclined axis for rotation relative to the hull about a vertical axis; and, control means for controlling the angular orientation of the sail assembly about the inclined axis.

2. The sailboat of claim 1 in which the control means comprise:

a line fastened to the sail assembly; and, decoupling means fully or partially decoupling the angle of attack of the sail assembly with respect to the wind from the rotation of the sail assembly about the vertical axis.

3. The sailboat of claim 2 in which the decoupling means comprise:

moveable means engaged with the line to draw at least a partial loop of the line from the rest of the line; and, means cooperating with the moveable mean to pay out the partial loop to the rest of the line in response to rotation of the support structure in either angular direction from a predetermined angular position and for hauling in the partial loop from the rest of the line in response to rotation of the support structure toward the predetermined angular position.

4. The sailboat of claim 3 in which:

the control means comprise a plurality of pulleys attached to the support structure and guiding movement of the line along a predetermined path; and, the moveable means comprise a frame and a pulley mounted to the frame and engaged with the line at a predetermined point along the path.

5. The sailboat of claim 4 in which:

the line is one line comprised by the control means; and, the means cooperating with the moveable mean comprise (a) another line separate from the one line and coupled to the moveable means; and, (b) means displacing the other line in response to rotation of the support structure thereby to pull the moveable element away from the one line in response to rotation of the support structure toward the predetermined angular position and releasing the moveable element in response to rotation of the support structure away from the predetermined angular position.

6. The sailboat of claim 1 in which:

the sail assembly comprises a flexible sheet and a shaft at the leading edge of the sail assembly to which the flexible sheet is fastened; and, a boom is fixed to the shaft in an orientation transverse to both the leading and trailing edges of the sail assembly; and, the control means comprise a line connected to the boom.

7. The sailboat of claim 1 in which:

the sail assembly comprises a wing that defines the leading edge and trailing edges of the sail assembly; and, the control means comprise a line fastened to the wing.

8. The sailboat of claim 1 in which:

the support structure comprises a generally vertical member that rotates about the vertical axis and a generally horizontal member that forms a junction with the generally vertical member and rotates with the generally vertical member about the vertical axis;

the generally vertical member comprises an upper end distant from the junction and supporting the upper rotary joint; and, the generally horizontal member comprises one end distant from the junction and supporting the lower rotary joint.

9. The sailboat of claim 8 in which:

the distant end of the generally horizontal member extends in a predetermined direction relative to the generally vertical member;

the generally horizontal member comprises an end proximate to the junction that extends in an opposite direction relative to the generally vertical member; and, a seating structure for a person is mounted to the proximate end of the generally horizontal member whereby, in use, the weight of the person seated in the seating structure counterbalances the weight of the sail assembly and the support structure.

10. The sailboat of claim 8 in which:

the distant end of the generally horizontal member extends in a predetermined direction relative to the generally vertical member;

the generally horizontal member comprises an opposing end proximate to the junction that extends in an opposite direction relative to the generally vertical member; and, a counterweight is mounted to the proximate end of the generally horizontal member to counterbalance the weight of the sail assembly and the support structure.

11. The sailboat of claim 8 in which the junction comprises:

a stub mast fixed to the hull in alignment with the vertical axis;

a vertical sleeve surrounding and rotating about the stub mast;

means mounting both the generally vertical member and the generally horizontal member to the sleeve for rotation together with the sleeve.

12. The sailboat of claim 8 in which the control means comprise biasing means for urging the sail assembly toward a rest position.

13. The sailboat of claim 12 in which the biasing means comprise:

a cam rotating with the sail assembly about the inclined axis; and, a spring-biased follower mounted to one of the generally horizontal and generally vertical members and engaged with the cam.

14. A sailboat comprising:

a plurality of hulls, a keel, and a rudder;

a sail assembly comprising a pair of opposing upper and lower ends, a leading edge extending between the opposing ends, and a trailing edge extending between the opposing ends;

support means supporting the sail assembly, the support means comprising a support structure supporting the sail assembly for rotation about an axis inclined relative to vertical and offset from the keel such that the plane defined by the line of action of the aerodynamic force of the sail assembly as it is rotated about the inclined axis passes substantially through a point below the center of mass of the boat and laterally aligned with the center of effort of the keel, the support structure comprising an upper rotary joint mounting the upper end of the sail assembly to the support structure and a lower rotary joint mounting the lower end of the sail assembly to the support structure, the rotary joints positioned to allow unobstructed rotation of the sail assembly fully through 360 degrees about the inclined axis;

mounting means mounting at least part of the support structure together with the sail assembly and the inclined axis for rotation relative to the hull about a vertical axis; and, control means for controlling the angular orientation of the sail assembly about the inclined axis.

* * * * *